US007644706B1

(12) United States Patent
Yoshida et al.

(10) Patent No.: US 7,644,706 B1
(45) Date of Patent: Jan. 12, 2010

(54) BREATHER DEVICE FOR AN ENGINE

(75) Inventors: Kozo Yoshida, Osaka (JP); Hiroshi Manabe, Osaka (JP); Mitsugu Okuda, Osaka (JP)

(73) Assignee: Kubota Corporation, Osaka (JP)

( * ) Notice: Subject to any disclaimer, the term of this patent is extended or adjusted under 35 U.S.C. 154(b) by 0 days.

(21) Appl. No.: 12/339,645

(22) Filed: Dec. 19, 2008

(51) Int. Cl.
*F01M 13/00* (2006.01)

(52) U.S. Cl. ..... 123/572; 123/574

(58) Field of Classification Search ..... 123/572–574, 123/41.86

See application file for complete search history.

(56) References Cited

U.S. PATENT DOCUMENTS

| | | | | |
|---|---|---|---|---|
| 6,148,806 | A * | 11/2000 | Mueller | 123/572 |
| 6,158,423 | A * | 12/2000 | Haack | 123/574 |
| 6,802,303 | B2 * | 10/2004 | Håkansson | 123/574 |
| 6,889,674 | B2 * | 5/2005 | Pateman et al. | 123/574 |

FOREIGN PATENT DOCUMENTS

| | | | |
|---|---|---|---|
| JP | 2004-116395 | A | 4/2004 |
| JP | 2006-022650 | A | 1/2006 |
| JP | 2008-045492 | A | 2/2008 |
| JP | 2008-075630 | A | 4/2008 |

* cited by examiner

*Primary Examiner*—M. McMahon
(74) *Attorney, Agent, or Firm*—Panitch Schwarze Belisario & Nadel LLP

(57) ABSTRACT

The blow-by gas that has flowed from a front-stage breather-chamber inlet (33) into a front-stage breather chamber (28) floats up around a preliminary valve-seat peripheral wall (22) and a preliminary breather-passage peripheral wall (24) and flows from a breather-chamber inlet (21) into a breather chamber (3). When a breather-chamber peripheral wall (12) is removed from a breather-chamber attaching seat (11), a diaphragm valve (16) is attached to the breather-chamber attaching seat (11) and has a valve face (18) seated on a preliminary valve seat (23), and a plug (27) is taken out of a preliminary breather outlet (25), from which a breather pipe (5) is led out, thereby enabling the front-stage breather chamber (28) to be used for a single-stage breather chamber provided with the diaphragm valve (16).

4 Claims, 4 Drawing Sheets

BREATHER DEVICE FOR AN ENGINE

BACKGROUND OF THE INVENTION

1. Technical Field

The present invention relates to a breather device for an engine, and more particularly concerns a breather device for an engine, which can assuredly obtain the oil-separation function required for using a supercharger.

2. Background Art

A conventional example of the engine breather devices comprises a cylinder head onto which a head cover is attached, the head cover being provided at a ceiling wall with a breather chamber having a breather outlet, from which a breather pipe is led out, this breather pipe having a led-out end portion connected to an air-intake route (for example, see Patent Literature 1) as well as the present invention.

The engine breather device of this type separates oil from the oil mist contained in the blow-by gas within the breather chamber and flows the remaining oil mist with the blow-by gas into the air-intake route, whereby the oil mist is prevented from flowing out of the breather device for the engine However, the conventional engine breather device is formed into a structure that the blow-by gas which has flowed from an inlet of the breather chamber into the breather chamber merely floats up around a peripheral wall of a valve seat and a peripheral wall of a breather passage and flows into the breather passage from a portion between an opened valve face and the valve seat. Therefore, it causes the following problem.

[Patent Literature 1] Patent Application Laid-Open No. 2004-116395 (see FIGS. 1 and 4)

SUMMARY OF THE INVENTION

<Problem> There is a case where the oil-separation function required for using the supercharger is not available.

In the event that the supercharger is used and has its air-intake port connected to a led-out end portion of a breather pipe, the blow-by gas passes through the breather chamber in more amount. Thus if the above-mentioned structure is adopted as it is, the required oil-separation function sometimes cannot be obtained.

The present invention has an object to provide a breather device for an engine, which can solve the above problem, and more specifically a breather device for an engine, which makes sure to obtain the oil-separation function required for using the supercharger.

(Invention of Claim 1)

The inventive featuring matter of the invention as defined in claim 1 is as follows.

As exemplified in FIG. 3, a breather device for an engine comprises a cylinder head 1 onto which a head cover 2 is attached, the head cover 2 being provided at its upper portion with a breather chamber 3 having a breather outlet 4 from which a breather pipe 5 is led out, the breather pipe 5 having a led-out end portion 6 connected to an air-intake route 7, wherein for connecting the led-out end portion 6 of the breather pipe 5 to an air-intake inlet 9 of a supercharger 8, the following arrangements are made.

As shown in FIG. 2(A) for example only, the head cover 2 is provided at its upper portion with a breather-chamber attaching seat 11 to which a breather-chamber peripheral wall 12 is detachably attached, the breather-chamber peripheral wall 12 having an upper surface formed with a valve-attaching seat 13, the breather-chamber peripheral wall 12 surrounding the breather chamber 3 within which a valve-seat peripheral wall 14 is arranged, this valve-seat peripheral wall 14 having an upper surface formed with a valve seat 15, a diaphragm valve 16 having a peripheral edge portion 17 attached to the valve-attaching seat 13 and having a valve face 18 seated on the valve seat 15, a breather-passage peripheral wall 19 spanning between the valve-seat peripheral wall 14 and the breather-chamber peripheral wall 12, which is provided with a breather outlet 4, a breather passage 20 that extends from a valve port 15*a* of the valve seat 15 to the breather outlet 4 being provided within the breather-passage peripheral wall 19, and as shown in FIG. 2(A) to FIG. 2(E), the breather chamber 3 having a lower portion provided with a breather-chamber inlet 21, whereby, as exemplified in FIG. 2(A), the blow-by gas flowed from the breather-chamber inlet 21 into the breather chamber 3 floats up around the valve-seat peripheral wall 14 and the breather-passage peripheral wall 19 and passes through a portion between the opened valve face 18 and the valve seat 15 to flow into the breather passage 20.

And as shown in FIG. 2(A) for example only, the head cover 2 is provided at its upper portion with a front-stage breather-chamber peripheral wall 10, at an upper portion of which the breather-chamber attaching seat 11 is provided, the front-stage breather-chamber peripheral wall 10 surrounding a front-stage breather chamber 28 within which a preliminary valve-seat peripheral wall 22 is disposed, the preliminary valve-seat peripheral wall 22 having an upper surface formed with a preliminary valve seat 23, the breather-chamber attaching seat 11 being adapted to attach the diaphragm valve 16 thereto, the preliminary valve seat 23 enabling the valve face 18 of the diaphragm valve 16 to seat thereon when the diaphragm valve 16 is attached to the breather-chamber attaching seat 11, a preliminary breather-passage peripheral wall 24 spanning between the preliminary valve-seat peripheral wall 22 and the front-stage breather-chamber peripheral wall 10, which is provided with a preliminary breather outlet 25, a preliminary breather passage 26 that extends from the preliminary valve port 23*a* of the preliminary valve seat 23 to the preliminary breather outlet 25 being provided within the preliminary breather-passage peripheral wall 24, the preliminary breather outlet 25 being sealed by a removal plug 27, the front-stage breather chamber 28 having a lower portion provided with a front-stage breather inlet 33, whereby the blow-by gas that has flowed from the front-stage breather-chamber inlet 33 into the front-stage breather chamber 28 floats up around the preliminary valve-seat peripheral wall 22 and the preliminary breather-passage peripheral wall 24 and flows from the breather-chamber inlet 21 into the breather chamber 3.

And as exemplified in FIG. 2(A), in the case where the breather-chamber peripheral wall 12 has been removed from the breather-chamber attaching seat 11, the diaphragm valve 16 is attached to the breather-chamber attaching seat 11 and has its valve face 18 seated on the preliminary valve seat 23, and the plug 27 is taken out of the preliminary breather outlet 25 from which the breather pipe 5 is led out, thereby enabling the front-stage breather chamber 28 to be used as a single-stage breather chamber provided with the diaphragm valve 16.

(Invention of Claim 5)

As illustrated in FIG. 3 for example only, an engine breather device comprises a cylinder head 1 onto which a head cover 2 is attached, the head cover 2 being provided at its upper portion with a breather chamber 3 having a breather outlet 4, from which a breather pipe 5 is led out, this breather pipe 5 having a led-out end portion 6 connected to an air-intake route 7, wherein the following arrangements are made for connecting the led-out end portion 6 of the breather pipe 5 to an air-intake port 9 of a supercharger 8.

As exemplified in FIG. 2(A), the head cover 2 is provided at its upper portion with the breather-chamber attaching seat 11 to which the breather-chamber peripheral wall 12 is attached, the breather-chamber peripheral wall 12 having an upper surface formed with a valve-attaching seat 13, the breather-chamber peripheral wall 12 surrounding the breather chamber 3 within which the valve-seat peripheral wall 14 is arranged, the valve-seat peripheral wall 14 having an upper face formed with a valve seat 15, a diaphragm valve 16 having a peripheral edge portion 17 attached to the valve-attaching seat 13 and having a valve face 18 seated on the valve seat 15, a breather-passage peripheral wall 19 spanning between the valve-seat peripheral wall 14 and the breather-chamber peripheral wall 12, which is provided with a breather outlet 4, a breather passage 20 that extends from a valve port 15*a* of the valve seat 15 to the breather outlet 4 being provided within the breather-passage peripheral wall 19, and as exemplified in FIG. 2(A) to FIG. 2(E), the breather chamber 3 having a lower portion provided with a breather-chamber inlet 21, whereby, as shown in FIG. 2(A), the brow-by gas that has flowed from the breather-chamber inlet 21 into the breather chamber 3 floats up around the valve-seat peripheral wall 14 and the breather-passage peripheral wall 19 and passes through a portion between the opened valve face 18 and the valve seat 15 to flow into the breather passage 20.

And as exemplified in FIG. 2(A) to FIG. 2(E), the breather chamber 3 has a lower portion provided with a breather-chamber bottom wall 29, which is provided with a breather-chamber inlet 21.

EFFECT OF THE INVENTION

Invention of Claim 1

<Effect> It is possible to assuredly obtain the oil-separation function required for using the supercharger.

As exemplified in FIG. 2(A), before the blow-by gas flows into the breather chamber 3, the blow-by gas that has flowed from the front-stage breather-chamber inlet 33 into the front-stage breather chamber 28 floats up around the preliminary valve-seat peripheral wall 22 and the preliminary breather-passage peripheral wall 24, thereby allowing the oil mist contained in the blow-by gas to condense on the surfaces of the preliminary valve-seat peripheral wall 22 and of the preliminary breather-passage peripheral wall 24 and then separate the oil. Further, the blow-by gas that has flowed from the breather-chamber inlet 21 into the breather chamber 3 floats up around the valve-seat peripheral wall 14 and the breather-passage peripheral wall 19, thereby allowing the oil mist contained in the blow-by gas to condense on the surfaces of the valve-seat peripheral wall 14 and of the breather-passage peripheral wall 19 and then separate the oil. As such, the oil-separation is performed doubly within the front-stage breather chamber 28 and the breather chamber 3. This ensures the oil-separation function required for using the supercharger 8 to be obtained.

<Effect> The front-stage breather chamber of the supercharged engine is also applicable to the naturally aspired engine.

As exemplified in FIG. 2(A), in the event that the breather-chamber peripheral wall 12 is removed from the breather-chamber attaching seat 11, the diaphragm valve 16 is attached to the breather-chamber attaching seat 11 and has its valve face 18 seated on the preliminary valve seat 23*a*. By removing the plug 27 from the preliminary breather outlet 25, the front-stage breather chamber 28 is available for the single-stage breather chamber provided with the diaphragm valve 16. Therefore, the front-stage breather chamber 28 is applicable to the naturally aspired engine which does not require a high oil-separation function.

<Effect> The naturally aspired engine can use the head cover as a part common to the engine of the present invention.

As exemplified in FIG. 2(A), the preliminary valve-seat peripheral wall 22 has the upper surface formed with the preliminary valve seat 23, and the diaphragm valve 16 is adapted to be attached to the breather-chamber attaching seat 11. When the diaphragm valve 16 is attached to the breather-chamber attaching seat 11, the preliminary valve seat 23 allows the valve face 18 of the diaphragm valve 16 to be seated thereon. In consequence, the naturally aspired engine can use the head cover 2 as a part common to the engine of the present invention.

Invention of Claim 2

It offers the following effect in addition to that given by the invention of claim 1.

<Effect> The oil-separation function is high within the front-stage breather chamber as well as within the breather chamber.

As shown in FIG. 2(A) for example only, the breather chamber 3 has a lower portion provided with a breather-chamber bottom wall 29, which is provided with the breather-chamber inlet 21. This allows the oil mist contained in the blow-by gas within the front-stage breather chamber 28 to condense on a lower surface of the breather-chamber bottom wall 29 and then separate the oil. Additionally, the oil mist contained in the blow-by gas within the breather chamber 3 to condense on an upper surface of the breather-chamber bottom wall 29 and then separate the oil. Therefore, the oil-separation function is high within the front-stage breather chamber 28 as well as within the breather chamber 3.

Invention of Claim 3

It offers the following effect in addition to that given by the invention of claim 2.

<Effect> The oil-separation function is high at the breather-chamber bottom wall.

As illustrated in FIGS. 2(B) to 2(E), an oil guide plate 31 is conducted out slantly downwards of an opening edge-portion 30 near the valve-seat peripheral wall 14 of the breather-chamber inlet 21. Accordingly, the portion that approaches the breather-chamber inlet 21, of the oil condensed on the lower surface of the breather-chamber bottom wall 29 is guided along the guide plate 31 slantly downwards. This prevents the disadvantage that the oil is entrained out from the breather-chamber inlet 21 into the breather chamber 3. For this reason, the oil-separation function is high at the breather-chamber bottom wall 29.

Invention of Claim 4

It offers the following effect in addition to that given by the invention as defined in claim 1.

<Effect> During the cold term, the breather chamber can be prohibited from being frozen.

As illustrated in FIG. 4, for arranging the supercharger 8 at an upper portion of an exhaust pipe 32, the breather-chamber peripheral wall 12 projects upwards of the head cover 2 and the breather pipe 5 is inclined downwardly from the breather outlet 4 toward the supercharger 8. Therefore, even if the water vapor condenses within the breather pipe 5, the condensed water does not flow into the breather outlet 4 by its own weight with the result of being able to inhibit the freezing of the breather chamber 3 during the cold term.

Invention of claim 5

<Effect> It is possible to assuredly obtain the oil-separation function required for using the supercharger.

As exemplified in FIG. 2(A) to FIG. 2(E), the breather-chamber bottom wall 29 is opened to provide the breather-chamber inlet 21, so that the oil mist contained in the blow-by gas before entering the breather chamber 3 condenses on the lower surface of the breather-chamber bottom wall 29 to separate the oil. Besides, the oil mist contained in the blow-by gas within the breather chamber 3 condenses on the upper surface of the breather-chamber bottom wall 29 to separate the oil. Therefore, the oil-separation is performed on the upper and lower surfaces of the breather-chamber bottom wall 29 as well as within the breather chamber 3 with the result of being able to ensure the acquisition of the oil-separation function required for using the supercharger 8.

Invention of Claim 6

<Effect> The oil-separation function is high at the breather-chamber bottom wall.

As illustrated in FIG. 2(A) to FIG. 2(E), the oil guide plate 31 is conducted out slantly downwards of the opening edge-portion 30 near the valve-seat peripheral wall 14 of the breather-chamber inlet 21. Accordingly, the portion that approaches the breather-chamber inlet 21, of the oil condensed on the lower surface of the breather-chamber bottom wall 29 is guided along the guide plate 31 slantly downwards. This prevents the disadvantage that the oil is entrained out from the breather-chamber inlet 21 into the breather chamber 3. For this reason, the oil-separation function is high at the breather-chamber bottom wall 29.

Invention of Claim 7

It offers the following effect in addition to that given by the invention as defined in claim 5.

<Effect> During the cold term, the breather chamber can be prohibited from being frozen.

As illustrated in FIG. 4, for arranging the supercharger 8 at the upper portion of the exhaust pipe 32, the breather-chamber peripheral wall 12 projects upwards of the head cover 2 and the breather pipe 5 is inclined downwardly from the breather outlet 4 toward the supercharger 8. Therefore, even if the water vapor condenses within the breather pipe 5, the condensed water does not flow into the breather outlet 4 by its own weight with the result of being able to inhibit the freezing of the breather chamber 3 during the cold term.

BRIEF DESCRIPTION OF THE DRAWINGS

FIG. 2(C) is a plan view of a front-stage breather-chamber peripheral wall.

MOST PREFERRED EMBODIMENT OF THE INVENTION

Hereafter, an explanation is given for an embodiment of the present invention based on the drawings.

FIGS. 1 to 4 show a breather device for an engine according to the embodiment of the present invention. In this embodiment, an explanation is given for a breather device for a diesel engine.

The embodiment of the present invention is outlined as follows.

Figure 3:
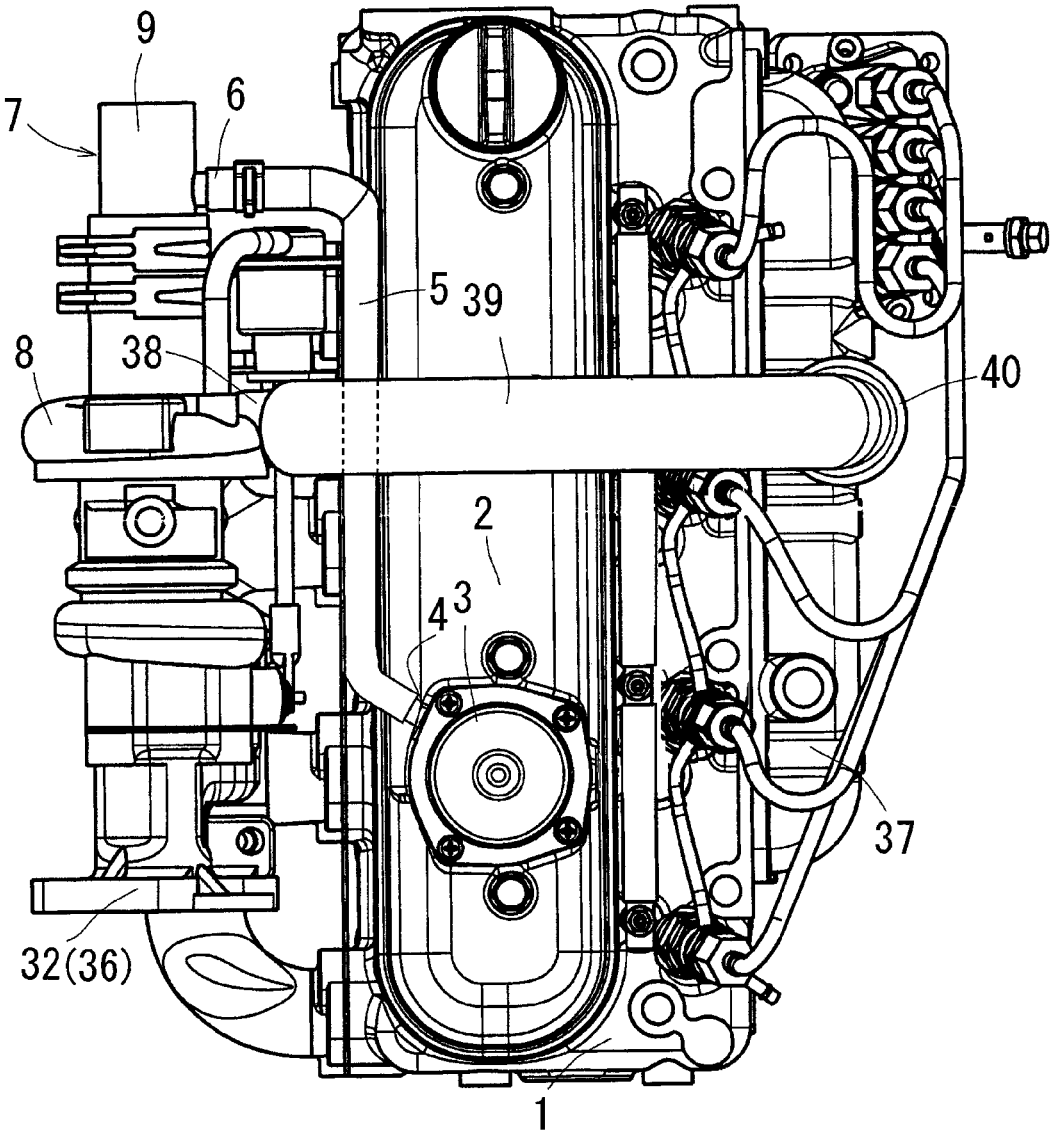
FIG. 3 is a plan view above a cylinder head of the engine provided with the breather device in FIG. 1.
Figure 4:
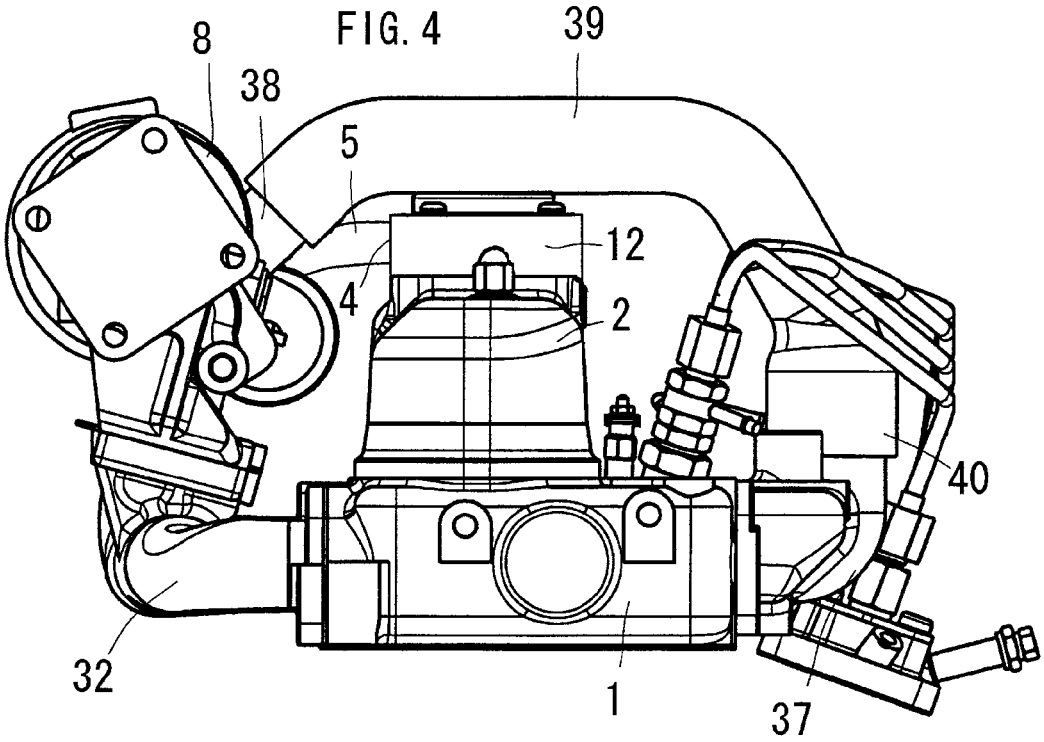
FIG. 4 is a rear view below the cylinder head of the engine provided with the breather device in FIG. 1.

As shown in FIG. 3, the engine comprises a cylinder head 1 to one lateral side of which an exhaust manifold 36 is attached and to the other lateral side of which an intake manifold 37 is attached, respectively. A head cover 2 is attached onto the cylinder head 1. The head cover 2 is provided at its upper portion with a breather chamber 3 having a breather outlet 4, from which a breather pipe 5 is led out. The breather pipe 5 has a led-out end portion 6 connected to an air-intake route 7. Concretely, a supercharger 8 has an air-intake inlet 9 to which the led-out end portion 6 of the breather pipe 5 is connected. As shown in FIGS. 3 and 4, the supercharger 8 has an air-intake outlet 38 from which a supercharging pipe 39 is conducted out and a conducted end 40 of the supercharging pipe 39 is connected to the intake manifold 37.

The breather chamber has the following construction.

Figure 1:
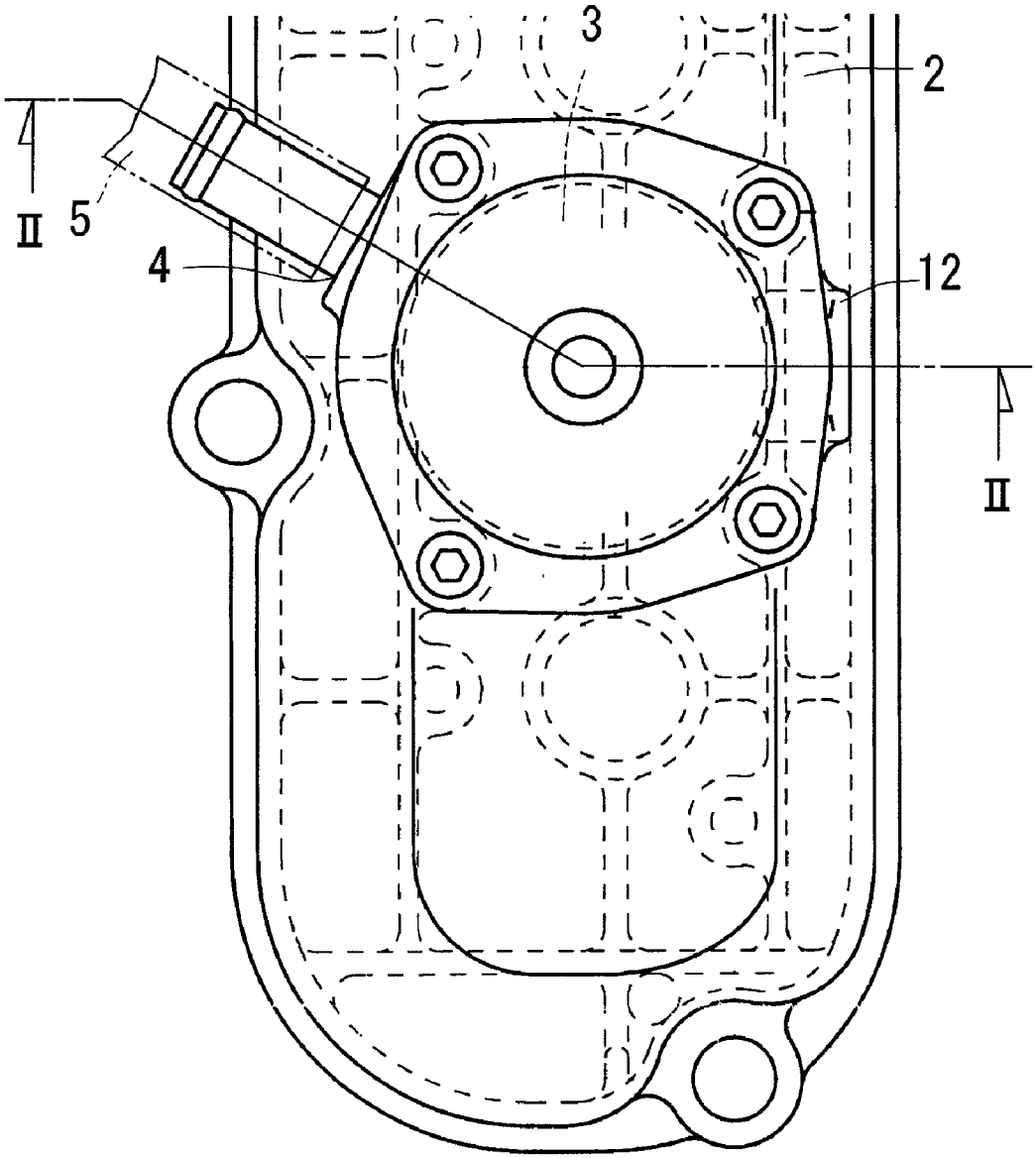
FIG. 1 is a plan view of a breather device for an engine and its vicinities according to an embodiment of the present invention.
Figure 2A:
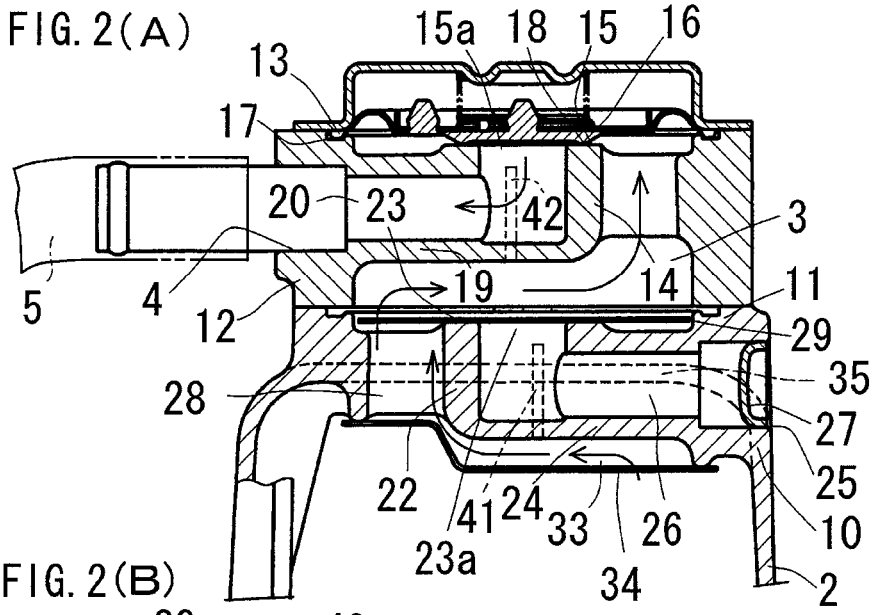
FIG. 2(A) is a sectional view taken along a line II-II in FIG. 1.

As shown in FIG. 2(A), the head cover 2 is provided at its upper portion with a breather-chamber attaching seat 11, to which a breather-chamber peripheral wall 12 is detachably attached. The breather-chamber peripheral wall 12 has an upper surface formed with a valve-attaching seat 13. The breather-chamber peripheral wall 12 surrounds the breather chamber 3 within which a valve-seat peripheral wall 14 is arranged. The valve-seat peripheral wall 14 has an upper surface formed with a valve seat 15. A diaphragm valve 16 has a peripheral edge portion 17 attached to the valve-attaching seat 13 and has a valve face 18 seated on the valve seat 15. A breather-passage peripheral wall 19 spans between the valve-seat peripheral wall 14 and the breather-chamber peripheral wall 12. The breather-chamber peripheral wall 12 is provided with a breather outlet 4. A breather passage 20 extending from a valve port 15*a* of the valve seat 15 to the breather outlet 4 is provided within the breather-passage peripheral wall 19. As shown in FIG. 2(C) to FIG. 2(E), the breather chamber 3 has a lower portion provided with a breather-chamber inlet 21, whereby the blow-by gas that has flowed from the breather-chamber inlet 21 into the breather chamber 3 floats up around the valve-seat peripheral wall 14 and the breather-passage peripheral wall 19 and passes through a portion between the opened valve face 18 and the valve seat 15 to flow into the breather passage 20.

A front-stage breather chamber has the following construction.

As shown in FIG. 2(A), the head cover 2 is provided at its upper portion with a front-stage breather-chamber peripheral wall 10, which has an upper portion provided with the breather-chamber attaching seat 11. The front-stage breather-chamber peripheral wall 10 surrounds the front-stage breather chamber 28 within which a preliminary valve-seat peripheral wall 22 is arranged. The preliminary valve-seat peripheral wall 22 has an upper surface formed with a preliminary valve seat 23. The diaphragm valve 16 is adapted to be able to be attached to the breather-chamber attaching seat 11. When the diaphragm valve 16 is attached to the breather-chamber attaching seat 11, the preliminary valve seat 23 enables the valve face 18 of the diaphragm valve 16 to be seated thereon. A preliminary breather-passage peripheral wall 24 spans between the preliminary valve-seat peripheral wall 22 and the front-stage breather-chamber peripheral wall 10. The front-stage breather-chamber peripheral wall 10 is provided with a preliminary breather outlet 25. A preliminary breather passage 26 that extends from a preliminary valve port 23*a* of the preliminary valve seat 23 to the preliminary breather outlet 25 is provided within the preliminary breather-passage peripheral wall 24. The preliminary breather outlet 25 is sealed by a detachable plug 27. The front-stage breather chamber 28 has a lower portion provided with a front-stage breather-chamber inlet 33.

Owing to the above arrangement, the blow-by gas that has flowed from the front-stage breather-chamber inlet 33 into the front-stage breather chamber 28 floats up around the preliminary valve-seat peripheral wall 22 and the preliminary breather-passage peripheral wall 24 and flows from the breather-chamber inlet 21 into the breather chamber 3. Further, when the breather-chamber peripheral wall 12 is removed from the breather-chamber attaching seat 11, the diaphragm valve 16 is attached to the breather-chamber attaching seat 11 and has its valve face 18 seated on the preliminary valve seat 23. The plug 27 is taken out of the preliminary breather outlet 25, from which a breather pipe 5 is conducted, thereby enabling the front-stage breather chamber 28 to be used for a single-stage breather chamber provided with the diaphragm valve 16. This allows the front-stage breather chamber 28 of the supercharged engine to be applicable to the naturally aspired engine. Thus the naturally aspired engine can utilize the head cover as a part common to the engine of the present invention.

As shown in FIG. 2(A), the front-stage breather chamber 28 has a lower portion at which a front-stage breather-chamber bottom wall 34 is disposed. Front and rear openings defined between the front-stage breather-chamber bottom wall 34 and a head-cover ceiling wall 35 serve as a front-stage breather-chamber inlet 33. A portion below the preliminary valve-seat peripheral wall 22 and the preliminary breather-passage peripheral wall 24 is stepped more downwardly than a portion below the breather-chamber inlet 21. A clearance is secured between the preliminary valve-seat peripheral wall 22 and a bottom surface of the preliminary breather-passage peripheral wall 24. Thus part of the blow-by gas that has flowed from the front-stage breather-chamber inlet 33 into the front-stage breather chamber 28 can flow along a bottom wall of the preliminary valve-seat peripheral wall 22 and that of the preliminary breather-passage peripheral wall 24, thereby enabling the oil mist to condense on their surfaces.

Figure 2B:
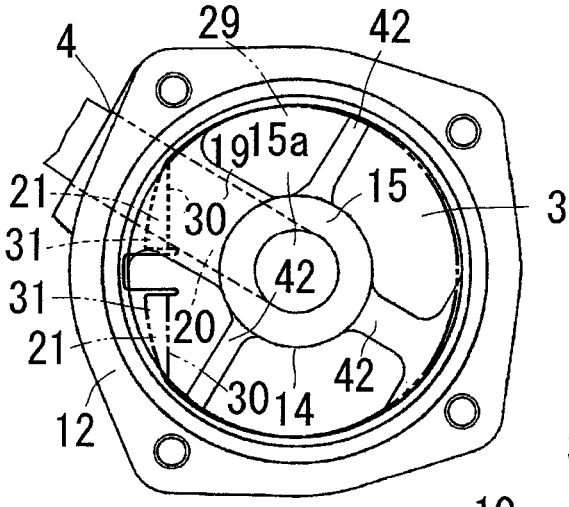
FIG. 2(B) is a plan view of a breather-chamber peripheral wall.
Figure 2D:
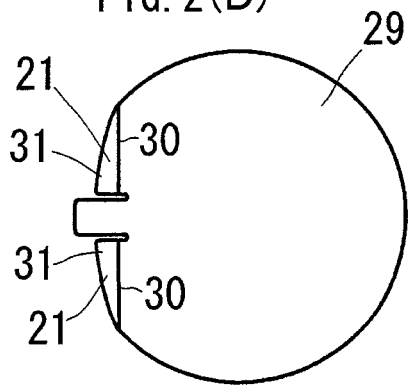
FIG. 2(D) is a plan view of a breather-chamber bottom wall.
Figure 2:
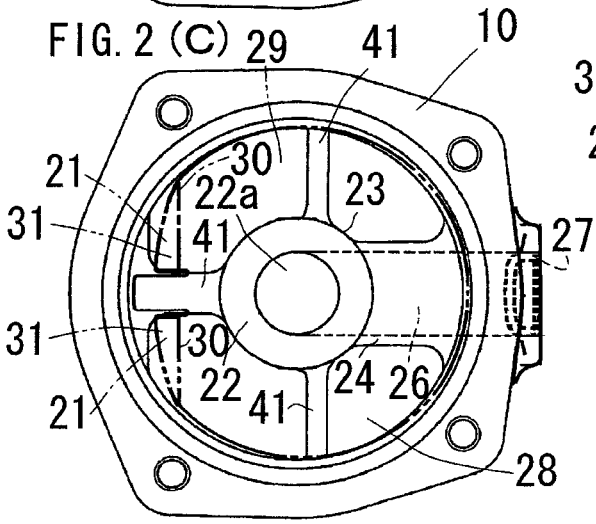
FIG. 2 shows the breather device in FIG. 1.
Figure 2E:
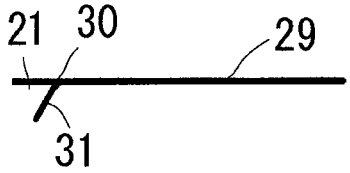
FIG. 2(E) is a side elevation view of the breather-chamber bottom wall.

As shown in FIG. 2(A) to FIG. 2(E), the breather chamber 3 is provided at its lower portion with the breather-chamber bottom wall 29, which is provided with the breather-chamber inlet 21. The oil guide plate 31 is conducted slantly downwards out of the opening edge-portion 30 near the valve-seat peripheral wall 14 of the breather-chamber inlet 21. As shown in FIGS. 2(D) and 2(E), the breather-chamber bottom wall 29 is formed in the shape of a circular plate having a peripheral edge, part of which is bent at two portions slantly downwards to form the breather-chamber inlet 21 and the oil guide plate 31. As shown in FIG. 2(A), the breather-chamber bottom wall 29 is placed on the preliminary valve seat 23 to close the preliminary valve port 23*a* of the preliminary valve seat 23. As shown in FIG. 2(C), a rib 41 spans between the preliminary valve-seat peripheral wall 22 and the front-stage breather-chamber peripheral wall 10 on a side opposite to the preliminary breather passage 26 with the preliminary valve-seat peripheral wall 22 held therebetween. The rib 41 is held to a portion between the oil guide plates 31 and 31 to fix the breather-chamber bottom wall 29 removably to the head cover 2. The breather-chamber bottom wall 29 may be secured by holding its peripheral edge portion to a portion between the breather-chamber attaching seat 11 and the breather-chamber peripheral wall 12. As shown in FIG. 2(C), two ribs 41 span between the preliminary valve-seat peripheral wall 22 and the front-stage breather-chamber peripheral wall 10 in a direction perpendicular to the preliminary breather passage 26. Further, as shown in FIG. 2(B), a rib 42 spans on the side opposite to the breather passage 20 with the vale-seat peripheral wall 14 interposed, between the valve-seat peripheral wall 14 and the breather-chamber peripheral wall 12. And two ribs 42 span in a direction perpendicular to the breather passage 20.

EXPLANATION OF NUMERALS (1) cylinder head
(2) head cover
(3) breather chamber
(4) breather outlet
(5) breather pipe
(6) led-out end portion
(7) air-intake route
(8) supercharger
(9) air-intake port
(10) front-stage breather-chamber peripheral wall
(11) breather-chamber attaching seat
(12) breather-chamber peripheral wall
(13) valve-attaching seat
(14) valve-seat peripheral wall
(15) valve seat
(15*a*) valve port
(16) diaphragm valve
(17) peripheral edge portion
(18) valve face
(19) breather-passage peripheral wall
(20) breather passage
(21) breather-chamber inlet
(22) preliminary valve-seat peripheral wall
(23) preliminary valve seat
(23*a*) preliminary valve port
(24) preliminary breather-passage peripheral wall
(25) preliminary breather outlet
(26) preliminary breather passage
(27) plug
(28) front-stage breather chamber
(29) breather-chamber bottom wall
(30) opening edge-portion
(31) oil guide plate
(32) exhaust pipe
(33) front-stage breather-chamber inlet

What is claimed is:

1. A breather device for an engine comprising a cylinder head (1) onto which a head cover (2) is attached, the head cover (2) being provided at its upper portion with a breather chamber (3) having a breather outlet (4) from which a breather pipe (5) is led out, the breather pipe (5) having a led-out end portion (6) connected to an air-intake route (7), wherein for connecting the led-out end portion (6) of the breather pipe (5) to an air-intake inlet (9) of a supercharger (8), the head cover (2) is provided at its upper portion with a breather-chamber attaching seat (11) to which a breather-chamber peripheral wall (12) is detachably attached, the breather-chamber peripheral wall (12) having an upper surface formed with a valve-attaching seat (13), the breather-chamber peripheral wall (12) surrounding the breather chamber (3) within which a valve-seat peripheral wall (14) is arranged, this valve-seat peripheral wall (14) having an upper surface formed with a valve seat (15), a diaphragm valve (16) having its peripheral edge portion (17) attached to the valve-attaching seat (13) and having a valve face (18) seated on the valve seat (15), a breather-passage peripheral wall (19) spanning between the valve-seat peripheral wall (14) and the breather-chamber peripheral wall (12), which is provided with a breather outlet (4), a breather passage (20) that extends from a valve port (15*a*) of the valve seat (15) to the breather outlet (4) being provided within the breather-passage peripheral wall (19), the breather chamber (3) having a lower portion provided with a breather-chamber inlet (21), whereby the blow-by gas flowed from the breather-chamber inlet (21) into the breather chamber (3) floats up around the valve-seat peripheral wall (14) and the breather-passage peripheral wall (19) and passes through a portion between the opened valve face (18) and the valve seat (15) to flow into the breather passage (20), the head cover (2) being provided at its upper portion with a front-stage breather-chamber peripheral wall (10), at an upper portion of which the breather-chamber attaching seat (11) is provided, the front-stage breather-chamber peripheral wall (10) surrounding a front-stage breather chamber (28) within which a preliminary valve-seat peripheral wall (22) is disposed, the preliminary valve-seat peripheral wall (22) having an upper surface formed with a preliminary valve seat (23), the diaphragm valve (16) being attached to the breather-chamber attaching seat (11), the preliminary valve seat (23) enabling the valve face (18) of the diaphragm valve (16) to seat thereon when the diaphragm valve (16) is attached to the breather-chamber attaching seat (11), a preliminary breather-passage peripheral wall (24) spanning between the preliminary valve-seat peripheral wall (22) and the front-stage breather-chamber peripheral wall (10), which is provided with a preliminary breather outlet (25), a preliminary breather passage (26) that extends from a preliminary valve port (23*a*) of the preliminary valve seat (23) to the preliminary breather outlet (25) being provided within the breather-passage peripheral wall (24), the preliminary breather outlet (25) being sealed by a removal plug (27), the front-stage breather chamber (28) having a lower portion provided with a front-stage breather-chamber inlet (33), whereby the blow-by gas that has flowed from the front-stage breather-chamber inlet (33) into the front-stage breather chamber (28) floats up around the preliminary valve-seat peripheral wall (22) and the preliminary breather-passage peripheral wall (24) and flows from the breather-chamber inlet (21) into the breather chamber (3), in the case where the breather-chamber peripheral wall (12) has been removed from the breather-chamber attaching seat (11), the diaphragm valve (16) is attached to the breather-chamber attaching seat (11) and has its valve face (18) seated on the preliminary valve seat (23), and the plug (27) is taken out of the preliminary breather outlet (25) from which the breather pipe (5) is led out, thereby enabling the front-stage breather chamber (28) to be used as a single-stage breather chamber provided with the diaphragm valve (16).

2. The breather device for the engine as set forth in claim 1, wherein the breather chamber (3) is provided at its lower portion with a breather-chamber bottom wall (29), which is provided with a breather-chamber inlet (21).

3. The breather device for the engine as set forth in claim 2, wherein an oil guide plate (31) is conducted out slantly downwards of an opening edge-portion (30) near the valve-seat peripheral wall (14) of the breather-chamber inlet (21).

4. The breather device for the engine as set forth in claim 1, wherein for arranging the supercharger (8) at an upper portion of an exhaust pipe (32), the breather-chamber peripheral wall (12) projects upwards of the head cover (2) and the breather pipe (5) is inclined downwardly from the breather outlet (4) toward the supercharger (8).

* * * * *